United States Patent [19]

Yoshiura et al.

[11] Patent Number: 4,739,369

[45] Date of Patent: Apr. 19, 1988

[54] COPYING APPARATUS EQUIPPED WITH ORIGINAL DOCUMENT CIRCULATION FEEDING ARRANGEMENT

[75] Inventors: Shoichiro Yoshiura; Haruyoshi Ikeda, both of Yamatokoriyama, Japan

[73] Assignee: Sharp Kabushiki Kaisha, Osaka, Japan

[21] Appl. No.: 862,977

[22] Filed: May 14, 1986

[30] Foreign Application Priority Data

| | | | |
|---|---|---|---|
| May 17, 1985 | [JP] | Japan | 60-106253 |
| May 17, 1985 | [JP] | Japan | 60-106258 |
| May 17, 1985 | [JP] | Japan | 60-106259 |
| May 31, 1985 | [JP] | Japan | 60-119375 |
| May 31, 1985 | [JP] | Japan | 60-119376 |

[51] Int. Cl.[4] ..... G03G 21/00; B65H 5/22

[52] U.S. Cl. ..... 355/14 R; 271/3.1; 355/14 SH

[58] Field of Search ..... 355/3 SH, 14 R, 14 SH, 355/14 C, 23, 24, 55; 271/3.1

[56] References Cited

U.S. PATENT DOCUMENTS

| | | | |
|---|---|---|---|
| 4,536,078 | 8/1985 | Ziehm | 355/14 SH |
| 4,609,283 | 9/1986 | Murata et al. | 355/14 R |

*Primary Examiner*—Fred L. Braun

*Attorney, Agent, or Firm*—Birch, Stewart, Kolasch & Birch

[57] ABSTRACT

A copying apparatus equipped with an original document circulation feeding arrangement for feeding to an original document platform. A plurality of original document sheets are stacked on an original document tray and sequentially feed from the original document sheet located at the lowermost position of the stack. The original document sheets are discharged from said original document platform, onto the uppermost position of the original document sheets stacked on said original document tray. The original document circulation feeding arrangement includes an original document size detecting member for detecting the sheet size of the original document during feeding thereof from said original document tray. An original document size memory member subjects the original document sheets stacked on the original document tray to one circulation before starting of copying function. During the time of circulation, the apparatus sequentially stores all the sheet sizes detected by the original document size detecting member in a memory of a control section.

10 Claims, 11 Drawing Sheets

COPYING APPARATUS EQUIPPED WITH ORIGINAL DOCUMENT CIRCULATION FEEDING ARRANGEMENT

BACKGROUND OF THE INVENTION

The present invention generally relates to a copying apparatus and more particularly, to a copying apparatus equipped with an original document circulation feeding arrangement adapted to feed a plurality of original document sheets placed or stacked on an original document tray, through circulation one sheet by one sheet, onto an original document platform.

Commonly, an automatic document feeder (referred to as an ADF) to be mounted on a copying apparatus includes an original document tray, an original document transport means and an original document discharge tray, and is arranged to lead a plurality of original document sheets placed on the original document tray to an original document platform, one sheet by one sheet, through the original document transport means, and to discharge said original document sheets onto the discharge tray after completion of predetermined functions. Meanwhile, a conventional original document circulation feeding apparatus is so arranged as to transport the original document sheet onto the original document platform, from the sheet located at the lowermost position of such original document sheets stacked on the original document tray, and to discharge the original document sheet on the original document platform onto the uppermost position of the original document sheets stacked on the original document tray after completion of the predetermined functions. By the above action, in the original document circulation feeding apparatus, the order of the original documents piled up on the original document tray is not altered even after termination of feeding function for all of the original document sheets. Generally, the conventional automatic document feeder including the original document circulation feeding apparatus is provided with a detecting means for detecting sizes of original document sheets for the purpose of effectively utilizing the function related to copy paper selection of the copying apparatus on which such automatic document feeder is to be mounted. In most of the known automatic document feeders, the detecting means as referred to above is provided in the vicinity of the original document tray so as to effect the detection of sizes of the original document sheets on the original document tray. Therefore, in the case where original document sheets in a plurality of various sheet sizes are simultaneously placed on the original document tray, only the maximum size of such paper sizes is detected, and the functions of the copying apparatus can not be fully utilized for the original documents having sizes smaller than that. Although there was also conventionally proposed an automatic document feeder having a detecting means arranged to detect sheet sizes during feeding of the original document sheets from the original document tray, such a detecting means was exclusively used for the classification of the original document sheets afer discharging thereof, since it is difficult to effect alteration of paper sheets, etc. after feeding of the original document sheets from the viewpoint of timing.

Accordingly, in any of the copying apparatuses provided with the prior art automatic document feeders, there has been such a disadvantage that it is impossible to continuously feed the original document sheets in a plurality of various sizes, to the original document platform, thereby to effect the copying operation based on copy paper sheets and data suitable for the original document sheets of the respective sheet sizes.

SUMMARY OF THE INVENTION

Accordingly, an essential object of the present invention is to provide a copying apparatus equipped with an original document circulation feeding arrangement which is capable of continuously effecting copying functions under conditions suitable for respective sheets sizes, with regard to original document sheets in a plurality of various sheet sizes, thus making it possible to effectively utilize the functions of the copying apparatus such as a copy paper sheet selecting function, etc.

Another important object of the present invention is to provide a copying apparatus equipped with an original document circulation feeding arrangement of the above described type which is capable of continuously effecting variable magnification copying functions under conditions suitable for respective sheet sizes, with regard to original document sheets in a plurality of various sheet sizes, through effective utilization of the variable magnification copying functions.

A further object of the present invention is to provide an automatic duplex copying apparatus equipped with an original document circulation feeding arrangement which is so arranged that in the case where original document sheets of a plurality of kinds of sheet sizes are stacked on an original document tray, the sizes of the original document sheets are memorized according to the order of stacking for effecting the functions for each size based on the memorized contents during the duplex copying mode, thereby to realize simplication of work and elimination of manpower through effective utilization of functions of the automatic duplex copying apparatus.

A still further object of the present invention is to provide an automatic duplex copying apparatus equipped with an original document circulation feeding arrangement which is so arranged tha, by preliminary detecting troubles such as abnormal duplex copying functions or shut-down, etc. which may take place by difference in sizes or in mounting direction of the original document sheets, an operator is allowed to realize the necessity for the processing related to the occurrence of the trouble before starting the copying function, whereby working efficiency can be improved through reduction of down-time during the copying operation.

Still another object of the present invention is to provide an automatic duplex copying apparatus equipped with an original document circulation feeding arrangement which is capable of indicating a double-feed of original document sheets upon occurrence thereof, with a warning indicating that the copying operation is not normally effected, thereby achieving simplification of work and elimination of man-power during the duplex copying operation.

In accomplishing these and other objects, according to one preferred embodiment of the present invention, there is provided a copying apparatus equipped with an original document circulation feeding arrangement which is constructed, with attention directed to the fact that the order of original document sheets placed or stacked on an original document tray is not altered even upon completion of the feeding function of all the original document sheets, and which includes an original document size detecting means for detecting the size of the original document sheet during feeding thereof from the original document tray, and an original document size memory means which subjects the original document sheets stacked on the original document tray to one circulation before starting of copying function and during this time, sequentially stores all of the sheet sizes detected by said detecting means in a memory of a control section.

By the above arrangement according to the present invention, it is possible to preliminarily find the sheet sizes and the number of sheets necessary for the copying operation of all of the original document sheets placed on the original document tray. Therefore, in the case where original document sheets in a plurality of various sizes are placed on the original document tray, required work such as alteration of paper sheets to be fed as related to the change of the original document sheet size, etc. after starting of the copying operation may be effected quickly in an efficient manner, and thus, the copying operation can be continuously effected with respect to the original document sheets having a plurality of various sheet sizes under conditions suited to the respective sheet sizes. Moreover, it becomes also possible to detect unsuitability or insufficiency of paper sheets related to the copying operation for particular original document sheet sizes prior to starting of said copying operation for warning to the operator. Accordingly, sufficient time is available for replacement of the unsuitable copy paper sheets or replenishment of the insufficient copy paper sheets, and thus, interruptions in the copying operation are eliminated, with a consequent improvement of working efficiency for the copying apparatus.

In another aspect of the present invention, there is provided a copying apparatus equipped with an original document circulation feeding arrangement adapted to feed to an original document platform, a plurality of original document sheets placed or stacked on an original document tray, sequentially from the original document sheet located at the lowermost position of the stack, and to discharge the original document sheet on said original document platform, onto the uppermost position of the original document sheets stacked on said original document tray. The original document circulation feeding arrangement includes an original document size detecting means for detecting the sheet size of the original document during feeding thereof from said original document tray, an original document size memory means which subjects the original document sheets stacked on said original document tray to one circulation before starting of the copying operation and during that time, sequentially stores all the sheet sizes detected by said original document size detecting means in a memory of a control section, a copy paper size calculating means for calculating copy paper sheet sizes required for the respective original document sheets from the sheet sizes stored in said original document size memory means and copying magnification set by input, and a required copy paper sheet display means for displaying the copy paper sheets sizes obtained by said copy paper size calculating means and suitability or insufficiency of said copy paper sheets.

By the above construction of the present invention, the sheet sizes and the number of sheets necessary for the copying operation of all the original document sheets placed on the original document tray can also be preliminarily found. Therefore, when original document sheets in a plurality of kinds of sizes are placed on the original document tray, copy paper sheet sizes corresponding to the respective original document sheets may be calculated based on the copying magnification set by input. Accordingly, it is possible to preliminarily find the required copy paper sheet sizes and the number of the copy paper sheets with respect to all of the original document sheets having a plurality of kinds of sizes and placed on the original document tray, and by displaying the size of the copy paper sheet, and unsuitability or insufficiency of said copy paper sheets through the required copy paper sheet display means, the operator can be urged to effect the preparation of the necessary copy paper sheets. Thus, through effective utilization of the variable magnification copying function, copying operations with varied magnifications may be continuously effected with respect to the original document sheets in the plurality of various sheet sizes.

In a further aspect of the present invention, there is also provided an automatic duplex copying apparatus equipped with an original document circulation feeding arrangement adapted to feed to an original document platform, a plurality of original document sheets stacked on an original document tray, sequentially from the original document sheet located at the lowermost position of the stack, and to discharge the original document sheet on said original document platform, onto the uppermost position of the original document sheets stacked on said original document tray, and arranged to transport the copy paper sheet copied on its one side, to the copying process section again through inversion of the feeding direction thereof. The original document circulation feeding arrangement includes an original document size detecting means for detecting the sheet size of the original document during feeding thereof from said original document tray, and original document size memory means which subjects the original document sheets stacked on said original document tray to one circulation before starting of copying operation and during that time, sequentially stores the sheet sizes detected by said original document size detecting means, and a grouping means which successively reads out the contents of said original document size memory means for grouping thereof according to the neighboring same sheet sizes.

According to the above construction of the present invention, it is so arranged that in the case where the both-side or duplex copying operation is to be effected with respect to the original document sheets in the plurality of kinds of sheet sizes stacked on the original document tray, all of the sheet sizes are detected by the original document size detecting means before starting of the copying function so as to be stored in the order of placing by the original document size memory means. During the duplex copying operation, the sheets are grouped according to each group of the same sheet size for effecting the duplex copying with respect to each group. Accordingly, the automatic duplex copying function may be effectively utilized even when the duplex copying is effected with respect to the original document sheets in the plurality of kinds of sheet sizes for simplication of the operation. Moreover, since the duplex copying operation can be continuously made with respect to the original document sheets in the plurality of kinds of sheet sizes, it is possible to realize the improvement of working efficiency of the copying apparatus and the elimiantion of man-power.

In a still further aspect of the present invention, there is further provided an automatic duplex copying apparatus equipped with an original document circulation feeding arrangement adapted to feed to an original document platform, a plurality of original document sheets stacked on an original document tray, sequentially from the original document sheet located at the lowermost position of the stack, and to discharge the processed original document sheet on said original document platform, onto the upper position of the other original document sheets placed on said original document tray. The original document circulation feeding arrangement includes an original document size memory means which subjects the original document sheets to one circulation before starting of the copying operation to detect the size of the original document sheets for storing in a memory, an original document size comparing means which sequentially reads out the original document size from said memory for comparison of sizes between two sheets of the original documents respectively corresponding to front and reverse faces of one copy paper sheet, an original document orientation comparing means for judging whether or not the directions for placing the original documents are the same, and a warning display means for giving warning when said comparing means judges that either one or both of the paper size and image forming direction are not in agreement.

By the arrangement of the present invention as described above, it is possible to preliminarily detect by the original document size comparing means and the original document orientation comparing means, occurrence of troubles which may take place due to the difference in the size and direction of placing of the original document sheets prior to starting of the copying operation. Through functionings of the above original document size comparing means and original document orientation comparing means, warning can be displayed in the case where the sizes of the original document sheets and/or the directions for forming the images are not in agreement between the front face and the reverse face of the copy paper sheet. Therefore, since the operator can find that the trouble takes place before starting of the copying operation to realize the necessity for the action for the remedy, and effect the preparation required therefore in advance, the down-time due to the trouble may be advantageously reduced.

In still another aspect of the present invention, there is also provided an automatic copying apparatus equipped with an original document circulation feeding arrangement adapted to feed to an original document platform, a plurality of original document sheets stacked on an original document tray, sequentially for the original document sheet located at the lowermost position of the stack, the to discharge the process original document sheet on said original document platform, onto the upper position of the original document sheets placed on said original document tray. The original document circulation feeding arrangement includes an original document memory means which subjects the original document sheets after being placed on the original document tray, to one circulation before starting of the copying function and during that time, sequentially detects the sizes of the respective original document sheets so as to store said detected size and the number of the original document sheets in a memory means, an original document size comparing means which detects the size of the original document sheet fed after starting of the copying function for comparison of this result of the size of the original document sheet stored in said original document memory means, an original document number comparing means for comparing the number of the original document sheets fed by the time of termination of the copying function and the number of the original document sheets stored in said memory, and a warning display means for giving warning when the results of comparison of said original document size comparing means or said original document number comparing means are not in agreement with each other.

By the above construction according to the present invention, the arrangement is so made that the sheet sizes and the number of sheets are detected before starting of the copying function with respect to all the original documents placed on the original document memory means, and after starting of the copying operation, the size of the original document sheet stored by the original document size comparing means is compared with the size of the fed original document sheet, while upon completion of the copying operation, the number of the original document sheets fed up to that time and the stored number of the original document sheets may be compared by the original document number comparing means. In the case where the results of comparison by these comparing means are not in agreement, the state can be displayed by the warning display means. Thus, when the size of the original document fed during the copying operation is different from the stored size due to a double feeding, or when the number of the original document sheets as fed is less than the number as stored due to occurrence of the double feeding, it can be displayed for the operator that the copying function has not been normally effected. Therefore, since the operator may find the occurrence of a double feeding if such a double feeding has taken place during unattended copying function, elimination of man-power in the copying operation may be achieved, without necessity for confirmation work by the operator.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
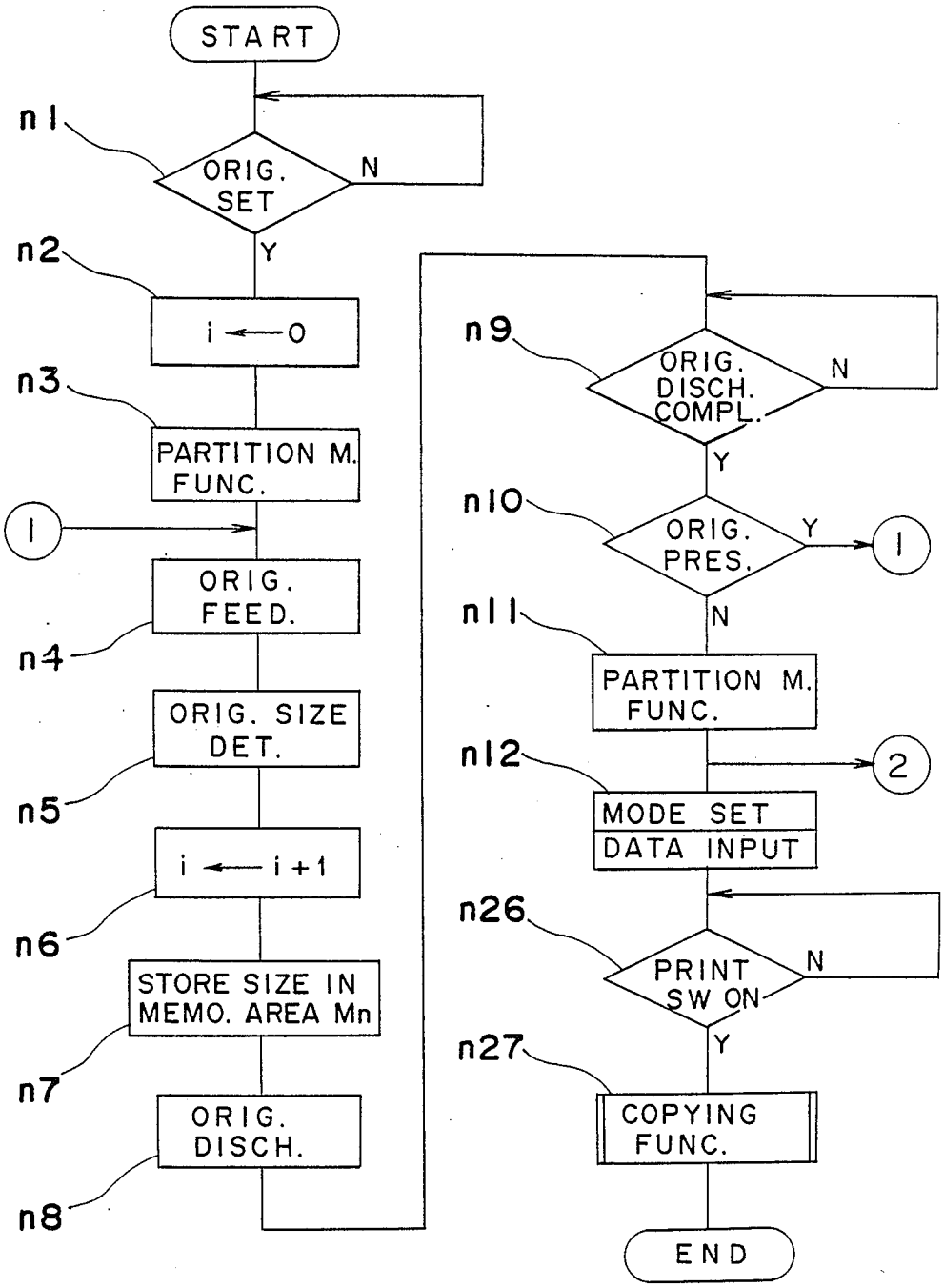
FIGS. 1(A) and 1(B) are flow-charts representing functions of a copying apparatus equipped with an original document circulation feeding arrangement according to one preferred embodiment of the present invention.

Before the description of the present invention proceeds, it is to be noted that like parts are designated by like reference numerals throughout the accompanying drawings.

Figure 2:
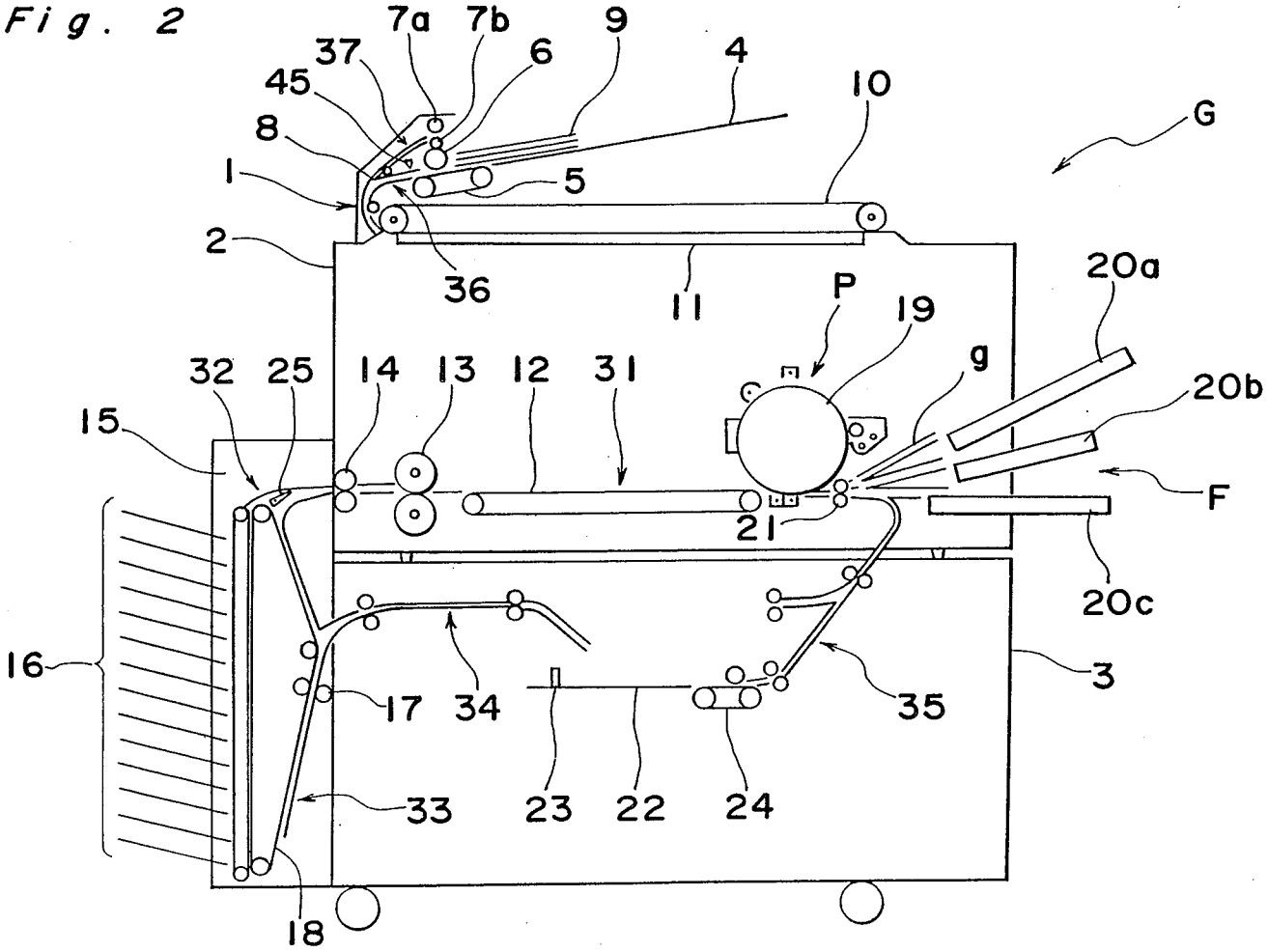
FIG. 2 is a schematic side sectional view showing general construction of the copying apparatus equipped with an original document circulation feeding arrangement referred to in FIGS. 1(A) and 1(B)

Referring now to the drawings, there is shown in FIG. 2, an automatic duplex copying apparatus G equipped with an original document circulation feeding arrangement 1 according to the present invention.

The copying apparatus G in FIG. 2 generally includes a copying apparatus main unit 2 placed on a base or cabinet 3, and a sorter 15 mounted at the left side of said main unit 2 as illustrated.

The copying apparatus main unit 2 includes a photoreceptor drum 19 rotatably mounted therein and having processing devices sequentially disposed therearound in a known manner to constitute a copying process section P, a copy paper feeding section F provided at the right side portion of the main unit 2 and having copy paper cassettes 20*a*, 20*b* and 20*c*, guide plates g and a pair of PS rollers 21 provided between the copy paper feeding section F and the copying process section P for leading the copy paper sheets (not shown) to said copying process section P in synchronization with the rotation of the photoreceptor drum 19 through rotation of the PS rollers 21, and a copy paper transport belt 12, a set of fixing rollers 13 and a pair of copy paper discharge rollers 14 sequentially disposed at the left side of the photoreceptor drum 19 to constitute a copy paper transport path 31 within the copying apparatus.

Meanwhile, the sorter 15 coupled to the left side of the main unit 2 includes an inner-sorter copy paper transport belt 18 movably disposed both in forward and reverse directions, bins 16 disposed in many stages at the left side wall of the sorter 15, an inner-sorter copy paper transport path 32 for transporting the copied paper sheets discharged from the discharge rollers 14 in the main unit 2 onto the bins 16, and a set of switch-back rollers 17 provided at the cabinet side of the transport belt 18 to constitute a switch-back transport path 33. Thus, it is so arranged that during the duplex copying operation, each copy paper sheet copied on its one side is fed into the switch-back transport path 33 by the function of a copy paper change-over claw 25 provided between the paths 32 and 33 so as to be further led into the cabinet 3, with the copy paper transport direction inverted. Meanwhile, each copy paper sheet completed for the duplex copying operation is also led into the switch-back transport path 33 so as to be accommodated in the bins 16, with its front and reverse faces inverted.

In the interior of the cabinet 3, there are provided an intermediate tray 22, a duplex copying transport path 34 disposed between said tray 22 and the switch-back transport path 33 in the sorter 15, and an inverting copy paper transport path 35 disposed between said intermediate tray 22 and the PS rollers 21 within the copying apparatus main unit 2. The intermediate tray 22 is further provided with a paper guide 23 for restricting the position of the stored copy paper sheets, and an intermediate tray copy paper feeding belt 24 for feeding the stored copy paper sheets towards the inverting copy paper transport path 35 successively from the copy paper sheet located at the lowermost portion in the stack of the stored copy paper sheets.

Above an original document platform 11 formed on the upper surface of the copying apparatus main unit 2, there is mounted the original document circulation feeding arrangement 1, which generally includes an original document transport belt 10, an original document feeding belt 5, an original document feeding roller 6, original document discharge rollers 7*a* and 7*b*, an original document changeover claw 8, and an original document tray 4 provided between said original document feed belt 5 and the original document feeding roller 6. Original document sheets 9 are placed or stacked on the original document tray 4 and sequentially fed from the sheet located at the lowermost position of the stack thereof. The original document transport belt 10 disposed above the original document platform 11 is intended to transport the original document sheet 9 fed by the belt 5 and roller 6 through an original document transport path 36, to a predetermined position on the original document platform 11. In the case where the original document sheet 9 is to be fed from the original document tray 4, the original document change-over claw 8 is positioned in the state as shown so as to open the original document transport path 36, in which there is provided an original document size detecting sensor 45 including a plurality of photo-sensors in position corresponding to an end portion for each size in a direction perpendicular to the original document sheet transport direction. By detecting the photosensors which are turned on in said plurality of photosensors, and the "on" time thereof, the size of the original document is specified. For recovery of the original document sheet placed on the original document platform 11, the change-over claw 8 is pivoted downwardly to open an original document recovering transport path 37. The transport belt 10 is adapted to be movable both in forward and reverse directions so as to feed the original document sheet onto the original document platform 11, and also to discharge such original document sheet onto the upper portion of the original document placed on the original document tray 4.

Figure 3:
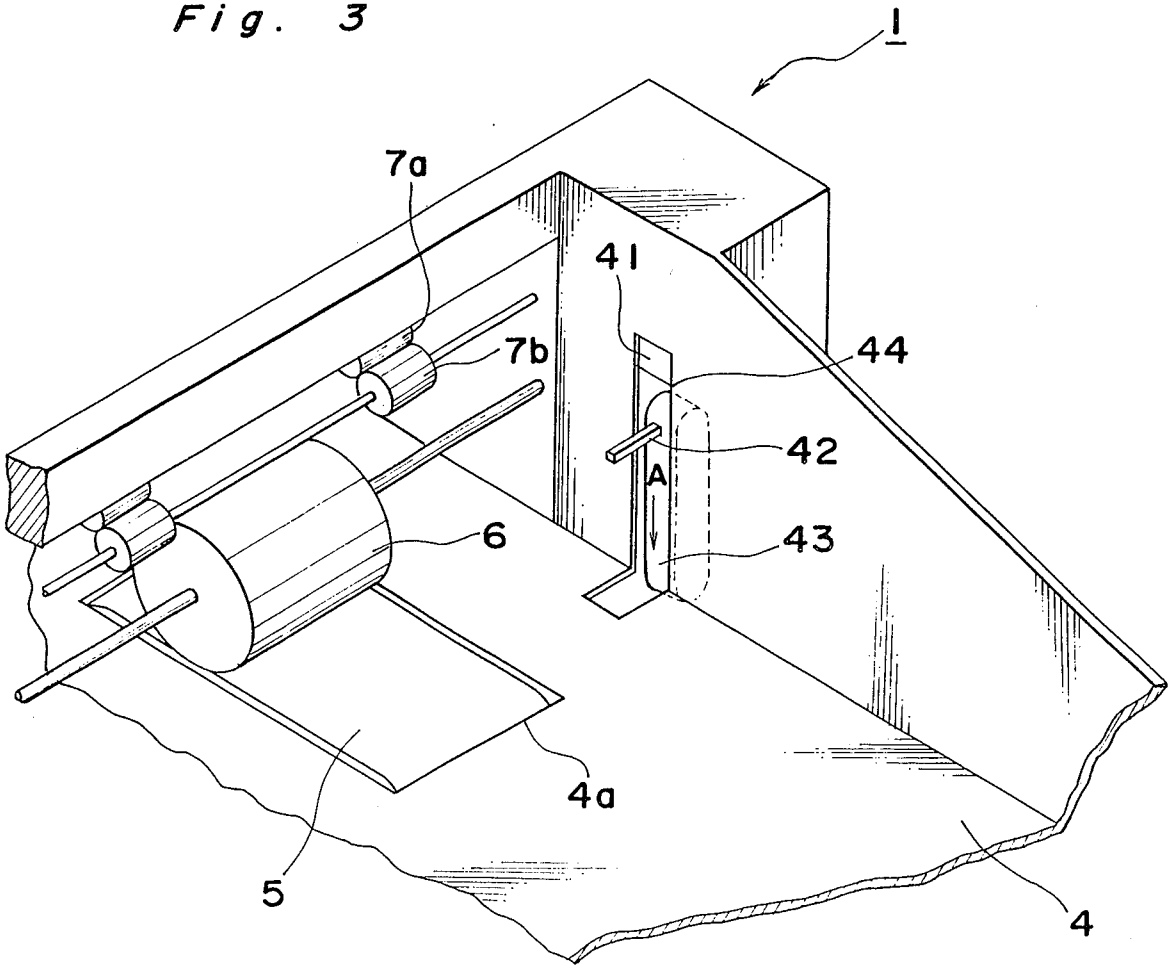
FIG. 3 is a fragmentary perspective view showing on an enlarged scale, a portion in the vicinity of an original document tray for the original document circulation feeding arrangement in FIG. 2.

More specifically, referring also to FIG. 3 showing on an enlarged scale, a portion of the original document circulation feeding arrangement 1 in the vicinity of the original document tray 4, said tray 4 is mounted between the original document feeding belt 4 partially exposed through an opening 4*a* formed in said tray 4 and the original document feeding roller 6, over which the original document discharge rollers 7*a* and 7*b* are disposed. The original document sheets 9 stacked on the tray 4 are successively fed from the sheet located at the lowermost position of the stack by the feeding belt 5 and the feeding roller 6 as described earlier. Meanwhile, the sheet transported in the discharging direction from the original document platform 11 is discharged by the discharge rollers 7*a* and 7*b*, onto the upper portion of the original document sheets stacked on the original document tray 4. In the side wall of the original document tray 4, there is formed an elongated vertical opening 44, through which a partition member 42 fixed to a belt 43 is moved. The belt 43 is driven in a direction indicated by an arrow A, and the partition member 42 travels along the outer periphery of said belt. Provided at the upper portion of the opening 44 is a shutter 41, which is intended to limit the protrusion of the partition member 42 when the original document sheets are to be placed on the original document tray 4. After the original document sheets are placed on the tray 4, the shutter 41 allows the opening 44 to open, and the partition member 42 is displaced in the direction of the arrow A through movement of the belt 43. Since the force for moving the belt 43 is extremely small, the partition member 42 stops its movement upon contact thereof with the upper face of the original document sheet placed on the tray 4. When the copying operation is started, the original document sheets stacked on the tray 4 are successively transported onto the original document platform 11 from the sheet located at the lowermost position in the stack, and the sheets finished for the copying operation are discharged onto the upper portion of the partition member 42. As the copying operation proceeds, the number of the original document sheets located at the lower portion of the partition member 42 is decreased, and after the last original document sheet is fed in the direction of the original document platform 11, the partition member 42 moves along the outer peripheral face of the belt 43 not confronting the original document tray 4 so as to be again exposed from the tray 4. By detecting the partition member 42 at a portion of the outer peripheral face of the belt 43 not facing the tray 4, the number of circulations of the original document sheets placed on the tray 4 may be found.

Figure 4:
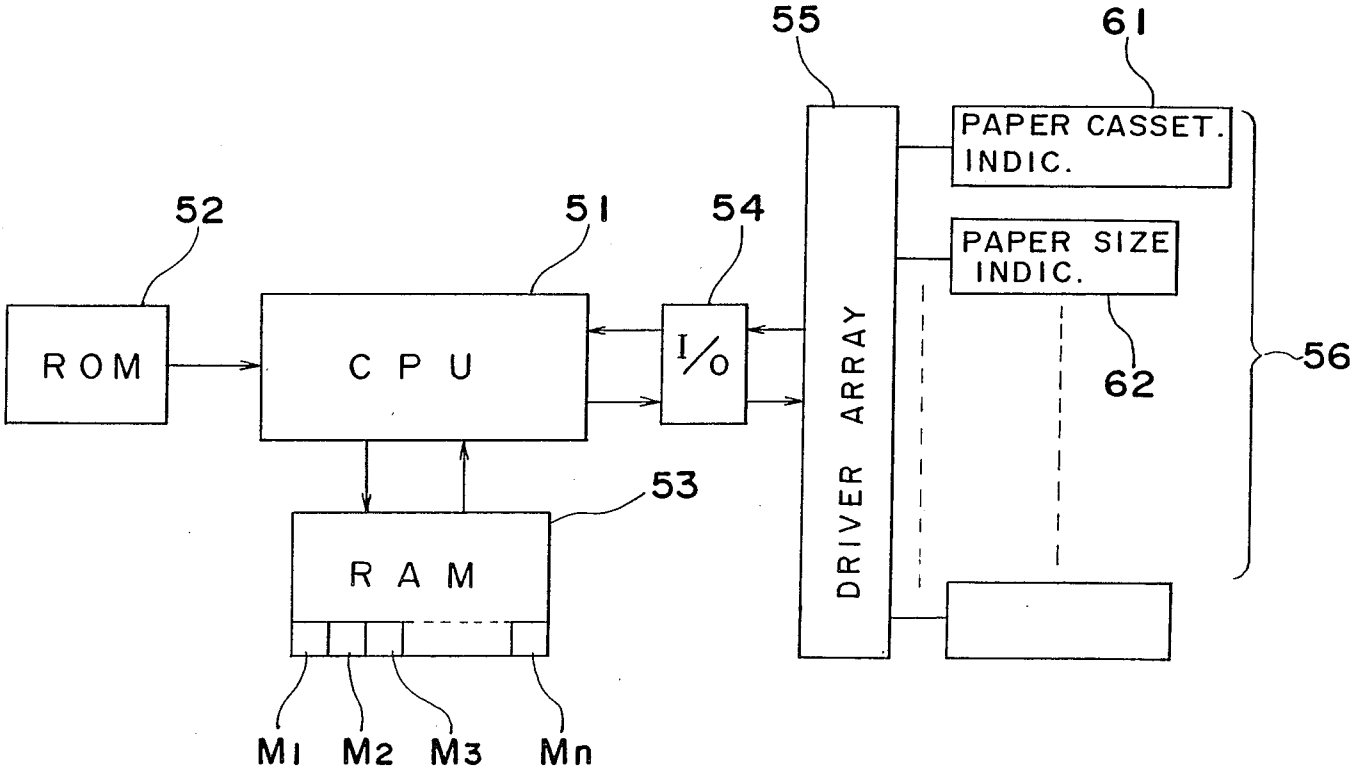
FIG. 4 is a block diagram showing construction of a control section for the copying apparatus equipped with the original document circulation feeding arrangement in FIG. 2.

Referring also to FIG. 4, there is shown a block diagram of a control section for the copying apparatus equipped with the original document circulation feeding arrangement 1 according to the present invention as described so far.

In FIG. 4, the control circuit generally includes a CPU (central processing unit) 51, and a ROM (read only memory) 52, a RAM (random access memory) 53, and an I/O interface 54 which are connected to the CPU 51 through internal bus lines, and a driver array 55 which is connected to the I/O interface 54 and coupled with a control section 56. In the ROM 52, a program for causing the CPU 51 to effect the preset function such as a function related to a set mode and the like is stored, while data to be inputted or outputted are stored in the RAM 53. At a portion of this RAM 53, there are provided memory areas M1, M2, M3, . . . and Mn for storing the original document sizes to be described later. The control section 56 includes a paper cassette indicator 61, and a paper size indicator 62, etc. The paper cassette indicator 61 is adapted to indicate copy paper sizes accommodated in the respective copy paper cassettes 20*a*, 20*b* and 20*c* attached to the copy paper feeding section F (FIG. 2), while the paper size indicator 62 urges the operator to prepare copy paper sheets of necessary sizes.

Referring to flow-charts of FIGS. 1(A) and 1(B), functioning of the copying apparatus equipped with the original document circulation feeding arrangement of the present invention as described so far will be explained hereinbelow.

After turning on a power source, at step n1, it is judged whether or not the original document sheets are set on the original document tray 4 of the original document circulation feeding arrangement 1. Upon setting of the original document sheets on the original document tray 4 at step n1, the procedure proceeds to step n2 to set the content of a pointer i to zero. This pointer i is intended to specify the numbers of the memory areas M1 to Mi provided in the RAM 53. Subsequently, at step n3, the belt 43 on the original document tray 4 is rotated to bring the partition member 42 into contact with the upper surface of the sheet located at the uppermost position of the original document sheets stacked on the tray 4. Therefore, at step n4, through operation of the original document feeding belt 5 and original document feeding roller 6, the original document sheet located at the lowermost position of the original document sheets stacked on the tray 4 is fed in the direction of the original document transport path 36, and at step n5, the size of the original document sheet is detected by the original document size detecting sensor 45. In this case, at step n6, one is added to the content of the point i, and at step n7, the detected size is stored in the memory area Mn. Then, at step n8, the original document transport belt 10 is moved in the reverse direction to effect the function for discharging the original document sheet on the original document platform 11 outwardly, through the original document recovering transport path 37. At this time, the original document change-over claw 8 is pivoted downwardly to open the transport path 37. The original document which has passed through said original document recovering transport path 37 is discharged onto the uppermost position of the original document sheets stacked on the tray 4 through rotation of the original document discharge rollers 7*a* and 7*b*. At step n9, upon completion of the above original document discharge function, it is judged, at step n10, whether or not any original document sheet remains on the tray 4, i.e., whether or not the sheet contacted by the partition member 42 at step n3 is staying on said tray 4 so as to be still held in contact with the partition member 42. At step n10, in the case where the original document sheet is remaining, the step is reverted to step n4 to effect the function for steps n4 to n9. By effecting the above functions for the number of the original document sheets placed on the original document tray 4, respective sheets sizes are detected with respect to all of the original document sheets placed on said tray 4 so as to be stored in the memory areas M1 through Mi provided in the RAM 53.

In the absence of the original document sheet at step n10, i.e., in the case where the partition member 42 is contacting no original document sheet in said step, said partition member 42 moves along the outer peripheral portion of the belt 43 through movement of said belt in the direction of the arrow A, and is located at the side face of the belt 43 not confronting the tray 4. The original document sheet contacting the partition member 42 at step n3 has been discharged onto the uppermost portion of the original document sheets at step n9, and the original document sheet coming into contact with the partition member 42 at step n11 is the same sheet as the sheet held in contact at step n3. In the functions as described so far, steps n4 through n10 are equivalent to the original document size detecting means and the original document size memory means according to the present invention.

Thereafter, at step n12, when the mode setting and setting of data such as the copying magnifications, etc. for the variable magnification copying apparatus are effected through input, sizes of the original document sheets stored in the memory areas M1 through Mi are read to at step n13. At step n14, the original document sheet size A as read out is multiplied by the copying magnification Z inputted at step n12, and thus, the necessary paper size B is found. Subsequently, at steps n15 through n17, it is judged respectively whether the required copy paper sheet size is A3, B4 or A4. In other words, in the case where the copy paper sheet size B is of A3, the step proceeds from step n15 to step n18, and the content of the pointer C1 for A3 size is rendered to be "1". Meanwhile, when the copy paper sheet size B is of B4, the step is shifted from step n16 to step n19 so as to set the content of the pointer C2 for B4 size to "1". If the copy paper sheet size B is of A4 size, the step proceeds from step n17 to step n20, and the content of the pointer C3 for A4 size is set to "1". In the case where the copy paper sheet size B is not of A3, B4 or A4 at steps n15 through n17, the size is judged to be of B5 size, and the content of the pointer C4 for B5 size is set to "1" at step n21. After setting the contents of the respective pointers to "1" at steps n18 through n21, the procedure proceeds to step n22, and it is judged whether or not the size of the original document sheet is stored in the next memory area. In the case where the subsequent memory area stores the original document sheet size, the procedure reverts to step n13 to repeat the functions in steps n13 to n22. By the above repetition of the functions for steps n13 to n22, the contents of the pointers for all of the copy paper sheet sizes necessary for the variable magnification copying function of the original document sheets placed on the original document tray 4, are rendered to be "1".

Subsequently, at step n23, the paper cassette indicator 61 corresponding to the cassette which accommodates the paper size for the content "1" in the pointers C1 through C4 is illuminated. Then, at step n24, it is judged whether or not there is any cassette which accommodates the paper size for the content "1" of the counter, and which is not attached to the paper feeding section F. In the presence of the cassette for the paper size not attached as yet, the paper size indicator 62 is turned on at step n25 so as to urge the operator to mount the paper cassette of the necessary size. At step n24, in the absence of the paper size not attached as yet, the procedure directly proceeds to step n26, and upon turning on of the print switch, the copying function is effected at step n27.

By the arrangement and functions as described so far, the original document sheets placed on the original document tray 4 are subjected to one circulation prior to the copying function, and during the above time, the original document sheet sizes are detected to be stored in the memory. By the original document size stored in the memory and the copying magnification set through input, the required copy paper size is calculated, and in the case where the paper cassette containing the copy paper sheets of that paper size is mounted on the copying apparatus, the paper cassette indicator 61 is turned on, while in the case where the paper cassette accommodating the copy paper sheets of a required size is not mounted, the size may be displayed on the paper size indicator 62. Accordingly, the operator can preliminarily prepare copy paper sheets necessary for continuously effecting the copying function related to the original documents of a plurality of sheet sizes placed on the original document tray 4, while detachment of a paper cassette containing copy paper sheets of a necessary size by mistake may be advantageously prevented, and thus, the variable magnification copying function of the copying apparatus is effectively utilized.

Modification 1

Figure 5A:
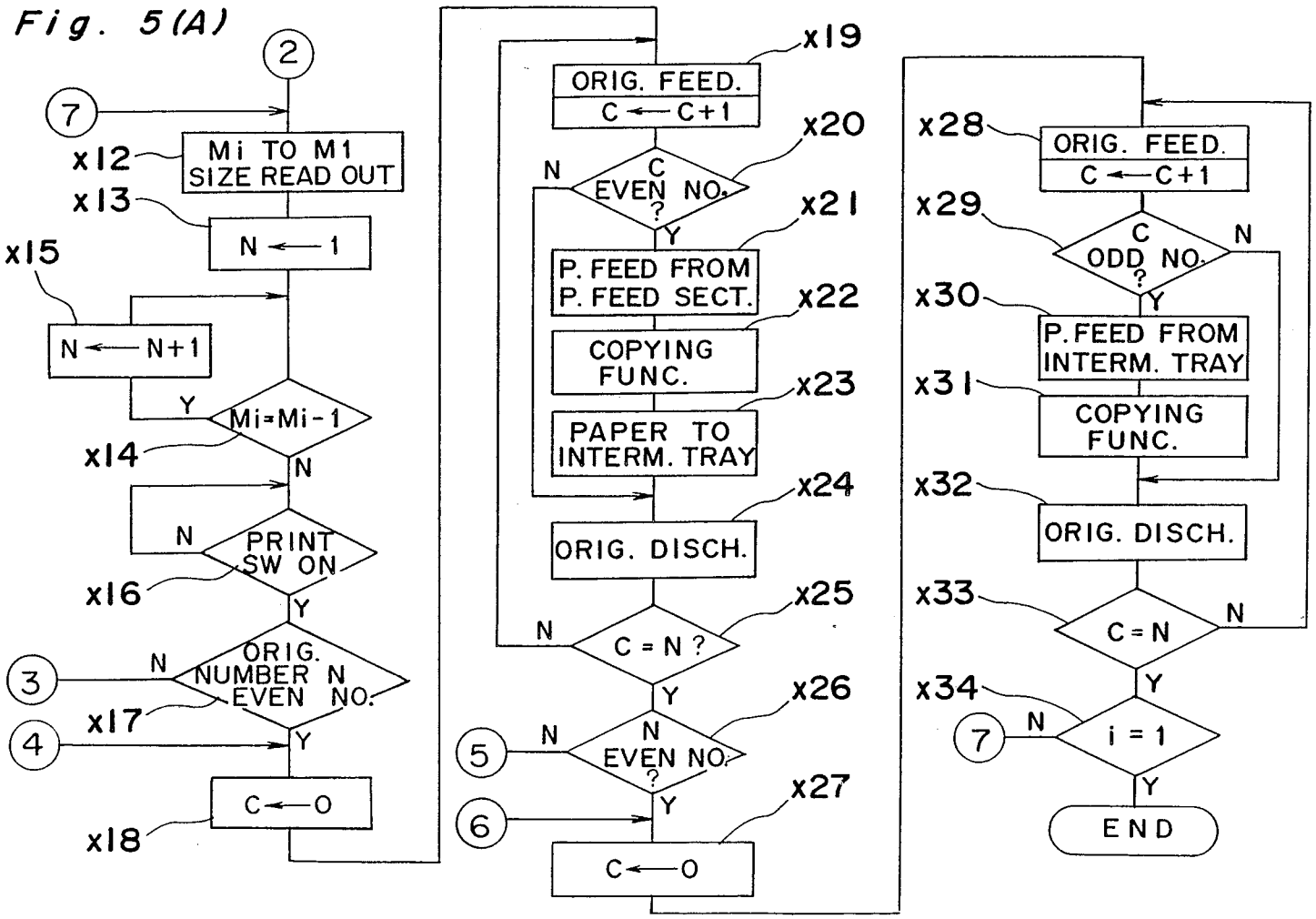
FIGS. 5(A), 5(B) and 5(C) are flow-charts representing a modification of FIG. 1(B)
Figure 5:
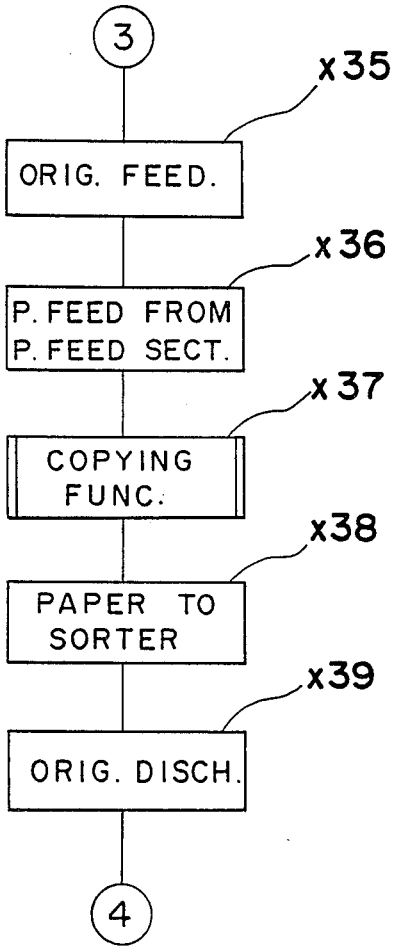
Figure 5:
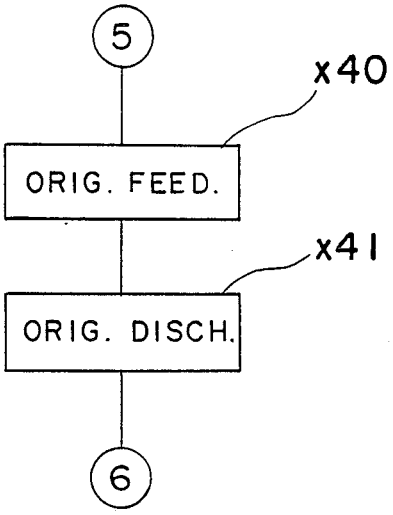

Referring to FIGS. 5(A), 5(B) and 5(C), there are shown flow-charts by which the flow-chart of FIG. 1(B) may be replaced for operating the copying apparatus according to the present invention in a manner as described hereinbelow.

After detecting the size of the original document sheets placed on the original document platform 11 based on the functions of steps n1 to n11 in FIG. 1(A), the original document sheet sizes stored in the memory areas are read out successively from Mi to M1 at step x12, and the content of the counter N is rendered to be "1" at step x13. The counter N is intended to count the number of the neighboring original document sheets of the same size. At step x14, it is judged whether or not the content of the memory area Mi is equal to the sheet size of M (i−1). In other words, judgement is made as to whether or not the size of one original document sheet is equal to the size of an original document sheet located therebelow. If the sizes thereof are equal to each other at step x14, the procedure proceeds to step x15, and reverts to step x14 after addition of "1" to the content of the counter N. By repeating the functions in the manner as steps x14→x15→x14, the number of original document sheets having the same size as that of the neighboring original document may be counted. Subsequently, at step x16, upon turning on of the print switch, the procedure proceeds to step x17, where it is checked whether or not the content of the counter N is of an even number. In the case where the content of the counter N is of the even number at step x17, the step is shifted to step x18 to clear an original document sheet number counter C. Then, at step x19, the original document sheet located at the lowermost position of the original document sheets placed on the original document tray 4 of the feeding arrangement 1, is fed onto the original document platform 11. At this time, "1" is added to the content of the counter C. At step x20, it is checked whether or not the content of the counter C is of an even number, and if the content is of the even number, i.e., the original documents are of pages in an odd number, paper feeding is started from the paper feeding section with the paper feeding cassettes, etc. at step x21 to effect the copying function at step x22.

The copy paper sheet completed for the copying function is transported to the intermediate tray 22 at step x23 for proceeding to step x24. At step x24, the sheet on the original document platform 11 is discharged onto the original document sheets placed on the tray 4 through the original document recovering transport path 37 of the original document circulation feeding arrangement 1. Thereafter, at step x25, the content of the counter C is compared with that of the counter N, and in the case where both contents are equal to each other, the procedure proceeds to step x26, while when these contents are not equal to each other, the procedure reverts to step x19 so as to effect the functions for steps x19 to x25.

In the case of the copying operation for the reverse faces, when the above described functions for the required number of the original document sheets have been completed, i.e., when the content of the counter C becomes equal to that of the counter N at step x25, it is judged at step x26, whether or not the content of the counter N is of an even number, and if it is of the even number, the content of the counter C is again rendered to be "0" at step x27. Subsequently, at step x28, the original document sheet is fed, and the content of the counter C is added by "1". Thereafter, at step x29, it is checked whether or not the content of the counter C is of an odd number, and if said content is of the odd number at step x29, i.e., when the original document sheets are of pages in an even number, the copy paper sheets each copied on one side thereof and stored on the intermediate tray 22 are transported to the copying process section through the inverting copy paper transport path 35 at step x30. Then, copying function is started at step x31. In the case where the content of the counter C is not of the odd number at step 29, i.e., when the original document sheets are in the odd number pages, the procedure proceeds directly to step x32. At step x32, the original document sheets placed on the original document platform 11 are discharged onto the tray 4 through the original document recovering transport path 37. Subsequently, at step x33, it is judged whether or not the content of the counter C is equal to that of the counter N, and if they are not equal to each other, the procedure is returned to step n28. After completion of the functions of steps x28 to x33 for the number of the original document sheets, i.e., when the content of the counter C has become equal to that of the counter N at step x33, the function is terminated.

In the case where the content of the counter N is of an odd number at step x17, the procedure is skipped to x35. At step x35, the copy paper sheet is fed from the original document circulation feeding arrangement 1 to the original document platform 11. Subsequently, at step x36, copy paper sheets are fed from the paper feeding section to effect the copying function at step x37. After completion of the copying function, the paper sheets finished for the one side copying are discharged into bins 16 of the sorter 15 at step x38, and at step x39, the original document sheet on the original document platform 11 is discharged onto the tray 4. Thereafter, the procedure is skipped to step x18 to effect the functions as described earlier.

Meanwhile, at step x26, when the content of the counter N is of an odd number, the original document sheet is fed from the feeding arrangement 1 at steps x40 and x41 so as to be discharged onto the tray 4 without effecting the copying functions. Then, the procedure reverts to step x27 to effect the function as described previously.

At step x34, judgement is made as to whether or not the content of the pointer i is of "1", and if it is not of "1", i.e., in the presence of any original document sheet not completed for the copying operation, the step is reverted to step x12 to repeat the function. On the other hand, when the content of the pointer i is of "1" at step x34, it is judged that the duplex copying operation has been completed for all of the original document sheets placed on the original document tray 4.

By the construction and functions as described above, the sheet sizes are detected for all of the original document sheets placed on the original document tray and memorized in the order of placing prior to starting of the duplex copying function, and the original document sheets may be grouped according to the respective neighboring sheets of the same size during the duplex copying function for effecting the copying operation. Accordingly, the duplex copying function suitable for the respective neighboring sheets of the same size can be carried out. By way of example, in the case where the duplex copying operation is to be effected with respected to eight sheets of original documents of B5, B5, B5, B5, A4, B5, B5 and B5 sizes continuous in pages respectively, the duplex copying function is effected in the odd number of sheets with respect to the B5 size sheets of the sixth to eighth pages and A4 size sheet of the fifth page, and also, in the even number of sheets with respect to the B5 size sheets of the first to fourth pages. After completion of the copying operation, paper sheets copied by the original document sheets only for the first and second pages, third and fourth pages, and fifth page and sixth and seventh pages and eighth page respectively may be obtained.

Modification 2

Figure 1B:
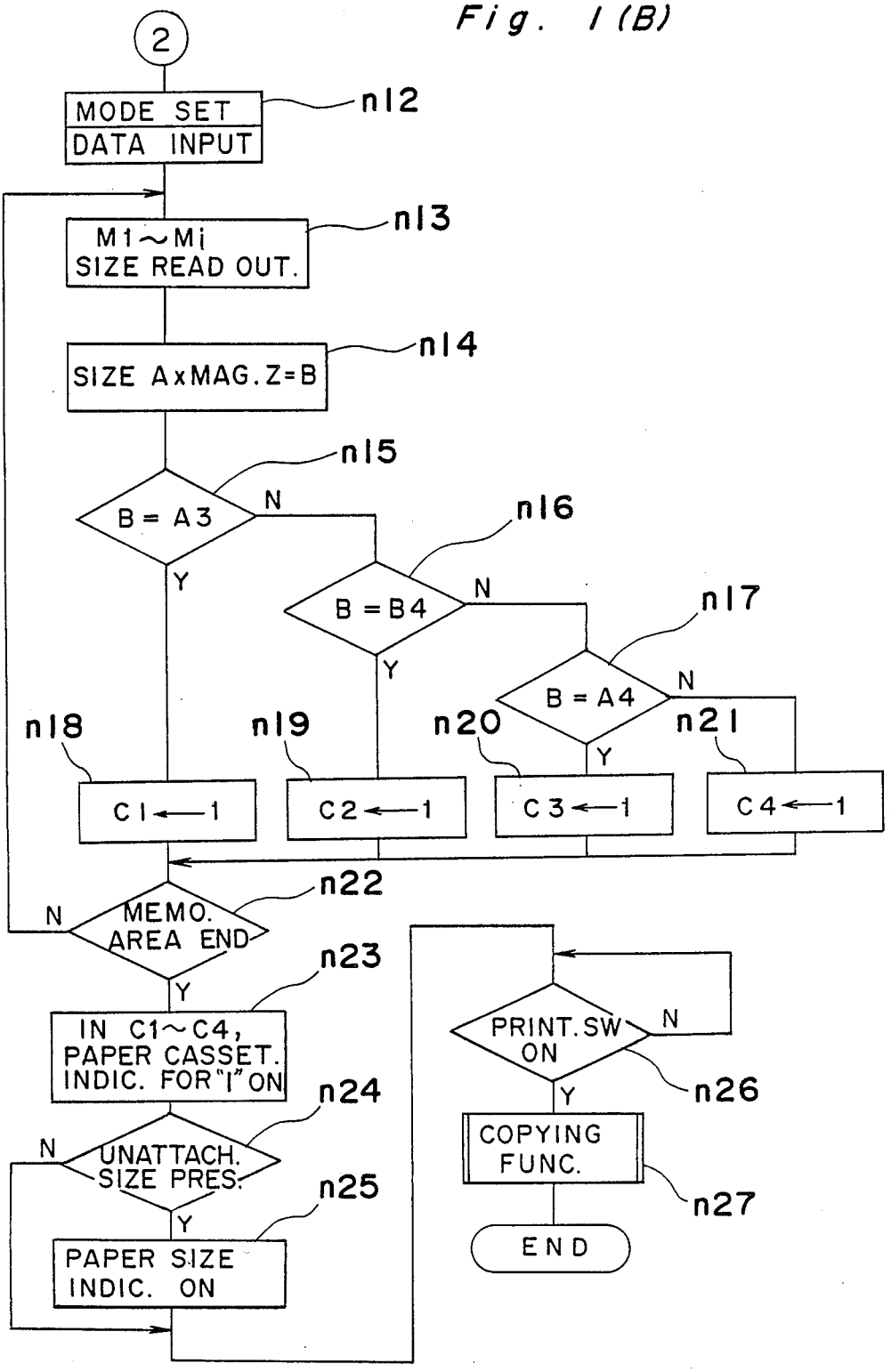
Figure 6A:
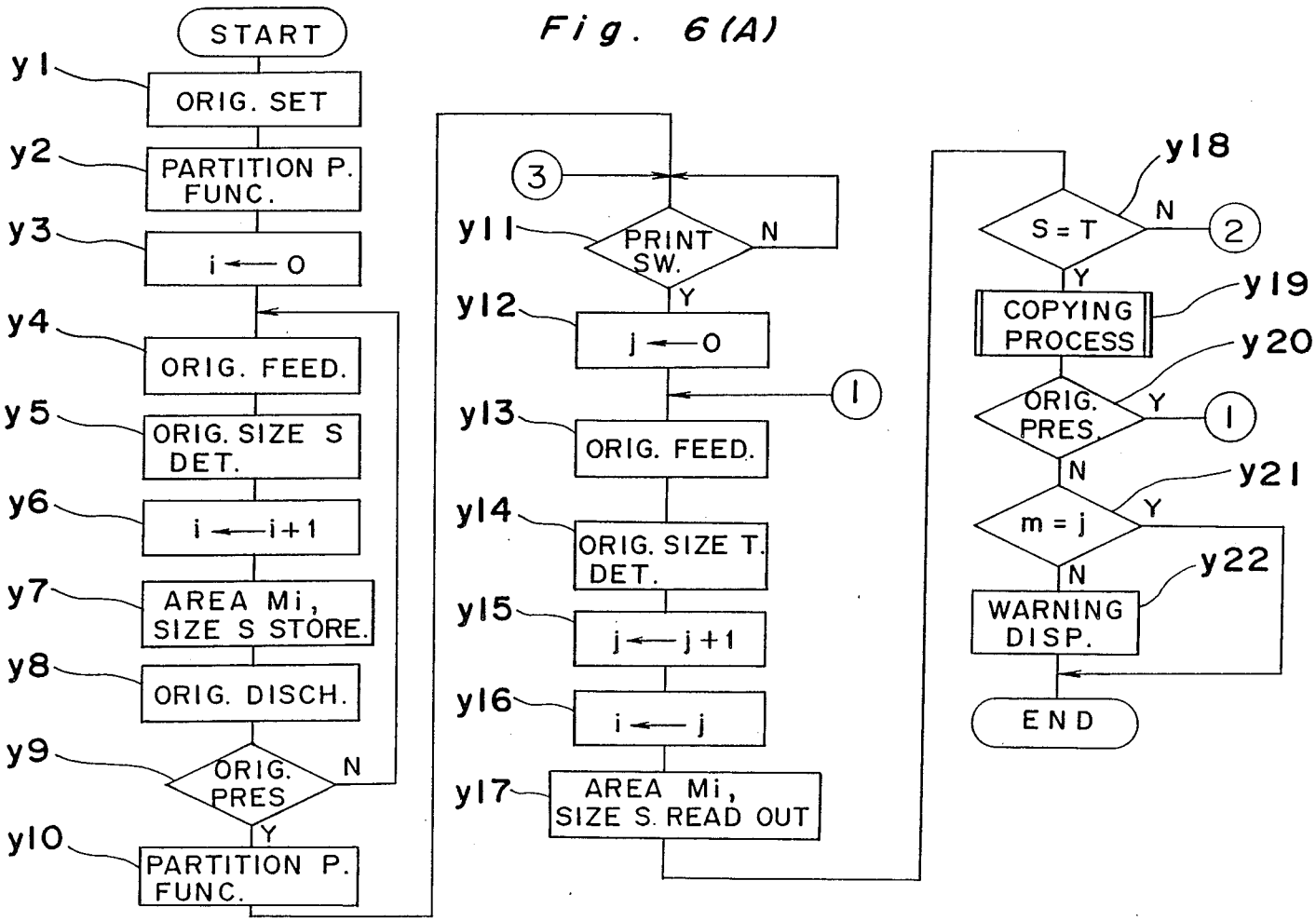
FIGS. 6(A) and 6(B) are flow-charts showing other modifications of FIGS. 1(A) and 1(B)
Figure 6B:
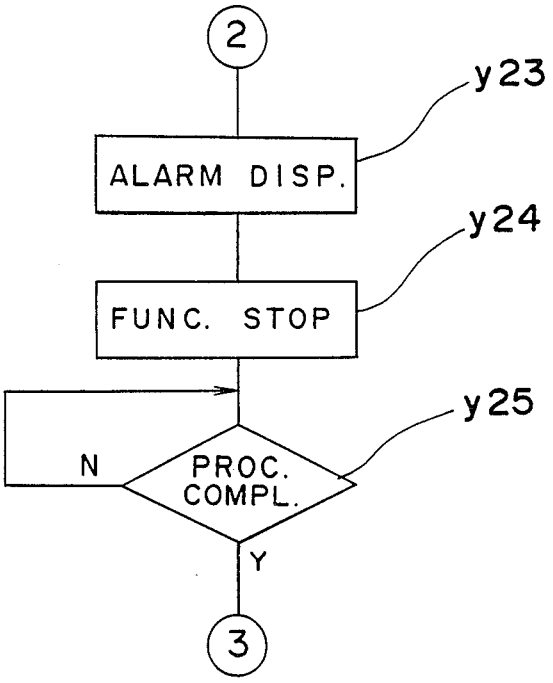

The flow-charts of FIGS. 1(A) and 1(B) may be replaced by modified flow-charts of FIGS. 6(A) and 6(B) for the operation of the copying apparatus according to the present invention.

In the flow-charts of FIGS. 6(A) and 6(B) representing functions of the automatic duplex copying apparatus equipped with the original document circulation feeding arrangement, upon setting of the original document on the tray 4 of the feeding arrangement 1 at step y1, the belt 43 is moved at step y2 to bring the partition member 42 into contact with the upper surface of the original document sheet located at the uppermost position of the stack of the original document sheets on the tray 4. Subsequently, at step y3, the content of the counter i is rendered to be "0", and at step y4, the original document sheets are successively fed towards the original document platform 11 from the sheet lcoated at the lowermost position of the stack of said original document sheets placed on the tray 4. The counter i is intended to calculate the number of fed original document sheets prior to starting of the copying operation. In this case, the size S of the original document sheet is detected at step y5. At step y6, the content of the counter i is added by "1", and the size S is stored in the area equivalent to the content of the counter i in the memory areas of the RAM 53 (step y7). Furthermore, at step y8, the original document sheets is discharged onto the uppermost position of the original document sheets placed on the tray 4, and at step y9, it is checked whether or not any original document sheet is present below the partition member 42. In the presence of the original document sheets below the partition member 42 at step y9, the procedure is reverted to step y4 to repeat the functions for steps y4 to y9. By the functions as described so far, the sheet sizes are detected with respect to all of the original documents placed on the tray 4 so as to be stored in the respective memory areas of the RAM 53. The functions of the steps y4 to y9 are equivalent to the original document memory means according to the present invention.

In the case where the original document sheets below the partition member 42 have run out, i.e., when the size detection and memorizing for all of the original document sheets have been completed, the procedure proceeds to step y10 so as to move the belt 43 for one revolution to again bring the partition member 42 into contact with the upper surface of the original document sheet located at the uppermost position of the stack of the original document sheets on the tray 4. Thereafter, when the print switch is operated at step y11, the copying function is started, and at step y12, the content of a counter j is set to be "0", with the feeding of the original document sheet related to the copying function being effected at step y13. This counter j is intended to count the number of original document sheets fed after starting of the copying function. Subsequently, at step y14, the size T of the original document sheet thus fed is detected by the original document size detecting sensor 45. At step Y15, "1" is added to the content of the counter j, and at step y16, the content of the counter i is rendered to be that of the counter j. Then, at step y17, the original document sheet size S stored in the memory area Mi specified by the content of the counter i is called out, and at step y18, comparison is made between the original document size S and the original document size T detected at step y14.

In the case where both of the sizes are equal to each other at step y18, the procedure proceeds to y19 to effect the copying process. At step y19, based on the original document size S stored in the memory area Mi and the number of pages of the original document sheets represented by the content of the counter i, it is judged whether or not the original document sheet to be processed is suitable for the duplex copying process, thereby to effect the copying process by selecting either one of the duplex copying process or one-side copying process. Subsequently, at step Y20, it is checked whether or not the original document sheets are present below the partition member 42, and if any original document sheets are present there, the procedure is reverted to step y13 to repeat the functions of steps y13 to y20. By the operation as described so far, copying function is effected with respect to all of the original document sheets placed on the tray 4. In the above functions, steps y14 to y18 are equivalent to the original document size comparing means of the present invention.

In the case where the original document sheet size S stored in the memory area Mi is not equal to the size T detected with respect to the original document sheet fed after starting of the copying function at step y18, the procedure is skipped to step y23 to illuminate the warning indicator 61 of the control section 56, and the copying function is stopped at step y24 to wait for the processing by the operator. Upon completion of the processing by the operator at step y25, the procedure reverts to step y11, and the copying operation is started again when the print switch is operated.

In the absence of any original document sheets below the partition member 42 at step y20, the procedure is shifted to step y21, where it is checked whether or not the maximum value m of the counter i is in agreement with the content of the counter j. In the case where both values are in agreement, the operation is terminated on the assumption that the copying function has been normally effected, whereas if they are not in agreement at step y21, the indicator 61 is lit at step y22 so as to inform the operator of the occurrence of the abnormal copying function. In the above functions, step y21 is equivalent to the original document number comparing means, while steps y22 and y23 are equivalent to the warning displaying means of the present invention.

By the construction and functions of this embodiment as described in the foregoing, it is possible to detect the sizes of the original document sheets before starting of the copying function so as to be stored in the respective memory areas provided in the RAM, while the number of the original document sheets can be found by the number of the memory areas. Furthermore, in the case of disagreement both in the comparison between the size of the original document sheet fed after starting of the copying operation and the size of the original document sheet stored in the memory area, and in the comparison between the number of original document sheets fed up to the completion of the copying function and the number of the memory areas, warning may be displayed to urge the operator to execute the correcting operation therefor.

Modification 3

Figure 7A:
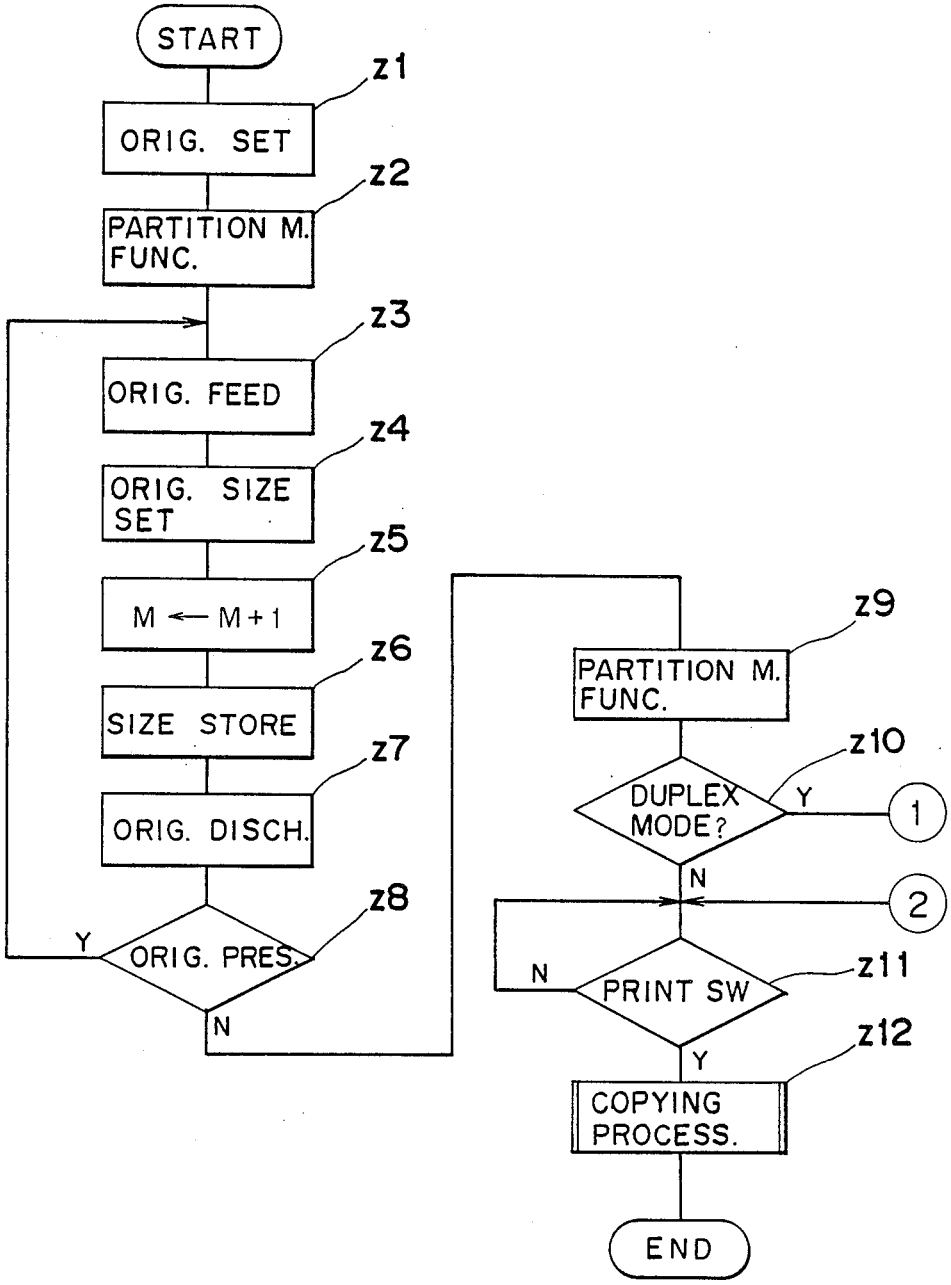
FIGS. 7(A), 7(B) and 7(C) are flow-charts showing modifications of FIGS. 6(A) and 6(B).
Figure 7B:
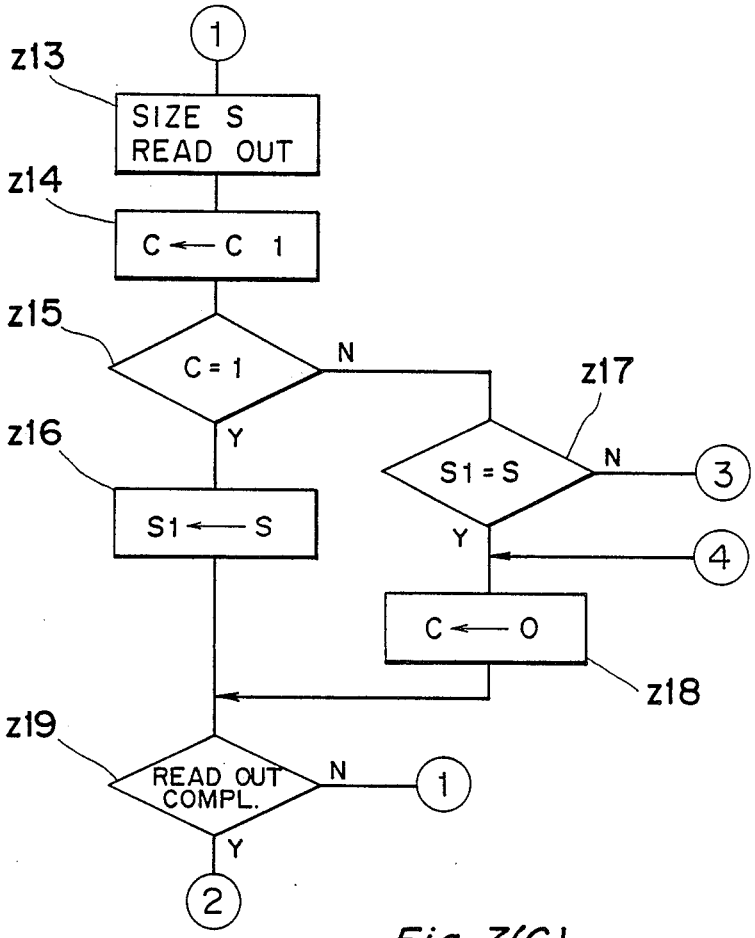
Figure 7C:
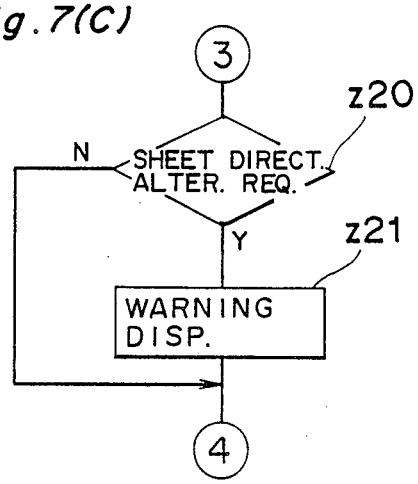

The flow-charts of FIGS. 6(A) and 6(B) may be replaced by modified flow-charts of FIGS. 7(A), 7(B) and 7(C) for the operation of the copying apparatus according to the present invention described hereinbelow.

In the flow-chart of FIG. 7(A), in the case where the original document sheets have run out below the partition member 42 at step z8, i.e., when the detection and memorization of the sizes for all of the original document sheets have been completed, the procedure proceeds to step z9, and the belt 43 is driven for one turn to again bring the partition member 42 into contact with the upper surface of the original document sheet located at the uppermost position of the stack of the original document sheets on the tray 4. Subsequently, at step z10, it is judged whether or not the set copying function is of the duplex mode.

In the case where the set copying function is not of the duplex mode, the step proceeds to step z11, and upon actuation of the print switch, copying process is effected at step z12.

In the case where the duplex mode is set at step z10, the procedure is shifted to step z13, where the original document size S is read out from the memory area Mi corresponding to the content of the counter i. Since the content of the counter i is equal to the number of the original document sheets placed on the tray 4, and during the detection of the original document sheet size, reading out is sequentially effected from the sheet located at the lowermost position, the size of the original document sheet for the first page is stored in the memory area Mi. Subsequently, at step z14, the content of the counter C is added by "1" for judgement at step z15, as to whether or not the content of said counter C is "1". When the content of the counter C is "1", the step is advanced to step z16, and the read out original document sheet size S is stored in the memory S1. Then, at step z19, judgement is made as to whether or not the reading out of the size S is completed, and if it is not finished as yet, the procedure is returned to step z13. In the case where the content of the counter C is not "1" at step z15, the step is advanced to step z17 for comparison between the size of the original document sheet previously read out and stored in the memory S1 and the size of the original document sheet read out this time. If both of the sizes are equal to each other at step z17, the procedure proceeds to step z18 and further, to step z19 by rendering the content of the counter C to "0". By the function in steps z14 to z18, the content of the counter C takes a value of "1" or "2" after reading out of the original document size. Owing to the fact that the reading out of the original document sheet size at step z13 is successively effected from the first page, the content of the counter C becomes "1" when the original document sheet size for the front surface is read out, and becomes "2" when the original document sheet size for the reverse surface is read out.

Accordingly, when the original document sheet size for the front surface is read out, the procedure proceeds in the order of steps z14→z15→z16→z19, while when the original document sheet size for the reverse surface is read out, the procedure proceeds as in steps z14→z15→z17→z18→z19. The size of the front surface original document sheet is stored in the memory S1 at step z16, while at step z17, the size of the front surface original document sheet is to be compared with the size of the reverse surface original document sheet. By repeating the functions of steps z13 to z19 as described above, it becomes possible to compare the original document sheet sizes corresponding to the front and reverse surfaces of the paper sheets with respect to all of the original document sheets placed on the original document tray. The functions of the above steps z13 to z19 are equivalent to the original document size comparing means of the present invention.

In case of disagreement between the front surface original document sheet size and the reverse surface original document sheet size at step z17, the procedure proceeds to step z20, and it is checked whether or not the directions or orientations of the images to be formed are the same. When the image orientations are the same at step z20, the procedure is returned to step z18, whereas if they are not the same, the procedure proceeds to step z21 to illuminate the indicator 61 of the control section 56. By the above function, it is possible to preliminarily inform the operator that the functioning is to be stopped after starting of the copying function, with the copying operation being thus interrupted. This step z21 is equivalent to the warning display means according to the present invention. Thereafter, the procedure is reverted to step z18, and the original document sheet size reading out function as described earlier is to be continued. After completion of the comparison with respect to all of the original document sheet sizes stored in the memory areas, the step is shifted to step z11 to wait for starting of the copying function.

By the above construction and functions, it becomes possible to inform the operator of the occurrence of the trouble during the copying operation and necessity for the remedy by giving warning in the case where the size of the front surface original document sheet is different from that of the reverse surface original document sheets, with disagreement in the directions for the image formation. Owing to the construction that the warning is given only when the sizes of the original document sheets are different for the front and reverse surfaces and the image forming directions are not in agreement, the arrangement of the present invention can cope with the duplex copying function utilizing the variable magnification copying function. Moreover, it may be so arranged that warning is immediately given when the size of the front surface original document sheet is different from that of the reverse surface original document sheet, and in this case, the arrangement can deal with the duplex copying function for a fixed magnification.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus equipped with an original document circulation feeding device adapted to sequentially feed individual sheets from a plurality of sheets stacked on an original document tray to an original document platform, said sheets are sequentially fed from the original document sheet located at the lowermost position of the stack and supplied to said original document platform, subsequently, the sheets are returned onto the uppermost position of the original document sheets stacked on said original document tray, said original document circulation feeding device comprising:

an original document size detecting means for detecting the sheet size of the original document during feeding thereof from said original document tray; and an original document size memory means for cycling the original document sheets stacked on said original document tray for one circulation before starting of a copying function and during the circulation sequentially stores all the sheet sizes detected by said original document size detecting means in a memory of a control section.

2. A copying apparatus according to claim 1, wherein said original document size memory means includes a partition member for detecting the completion of one circulation.

3. A copying apparatus equipped with an original document circulation feeding device adapted to sequentially feed individual sheets from a plurality of sheets stacked on an original document tray to an original document platform, said sheets are sequentially fed from the original document sheet located at the lowermost position of the stack and supplied to said original document platform, subsequently, the sheets are returned onto the uppermost position of the original document sheets stacked on said original document tray, said original document circulation feeding device comprising:

an original document size detecting means for detecting the sheet size of the original document during feeding thereof from said original document tray;

an original document size memory means for cycling the original document sheets stacked on said original document tray for one circulation before starting of a copying operation and during the circulaion sequentially stores all the sheet sizes detected by said original document size detecting means in a memory of a control section;

a copy paper size calculating means for calculating copy paper sheet sizes required for the respective original document sheets from the sheet sizes stored in said original document size memory means and copying magnification set by input; and a required copy paper sheet display means for displaying the copy paper sheet sizes obtained by said copy paper size calculating means and suitability or insufficiency of said copy paper sheets.

4. A copying apparatus according to claim 3, wherein said original document size memory means includes a partition member for detecting the completion of one circulation.

5. A copying apparatus equipped with an original document circulation feeding device adapted to sequentially feed individual sheets from a plurality of sheets stacked on an original document tray to an original document platform, said sheets are sequentially fed from the original document sheet located at the lowermost position of the stack, and supplied to said original document platform, subsequently, the sheets are returned onto the uppermost position of the original document sheets stacked on said original document tray, and arranged to transport the copy paper sheet copied on its one side to the copying process section again through inversion of the feeding direction thereof, said original document circulation feeding device comprising:

an original document size detecting means for detecting the sheet size of the original document during feeding thereof from said original document tray;

an original document size memory means for cycling the original document sheets stacked on said original document tray for one circulation before starting of a coping function and during the circulation sequentially stores all the sheet sizes detected by said original document size detecting means; and a grouping means which succesively reads out the contents of said original document size memory means for grouping thereof according to the neighboring sheets of the same size.

6. A copying apparatus according to claim 5, wherein said original document size memory means includes a partition member for detecting the completion of one circulation.

7. A copying apparatus equipped with an original document circulating feeding device adapted to sequentially feed individual sheets from a plurality of sheets stacked on an original document tray to an original document platform, said sheets are sequentially fed from the original document sheet located at the lowermost position of the stack and supplied to said original document platform, subsequently, the sheets are returned onto the upper position of the other original document sheets stacked on said original document tray, said original document circulation feeding device comprising:

an original document size memory means for cycling the original document sheets for one circulation before starting of a copying operation to detect the size of the original document sheets for storing in a memory;

an original document size comparing means which sequentially reads out the original document size from said memory for comparison of sizes between two sheets of the original documents respectively corresponding to front and reverse faces of one copy paper sheet;

an original document orientation comparing means for judging whether or not the directions for placing the original document sheets are the same; and a warning display means for giving warning when said comparing means judges either one or both of the sheet size and image forming directions are not in agreement.

8. A copying apparatus according to claim 7, wherein said original document size memory means includes a partition member for detecting the completion of one circulation.

9. A copying apparatus equipped with an original document circulation feeding device adapted to sequentially feed individual sheets from a plurality of sheets stacked on an original document tray to an original document platform, said sheets are sequentially fed from the original document sheet located at the lowermost position of the stack and supplied to said original document platform, subsequently, the sheets are returned onto the upper position of the other original document sheets stacked on said original document tray, said original document circulation feeding device comprising:

an original document memory means for cycling the original document sheets after being placed on the original document tray for one circulation before starting of a copying function, and during the circulation sequentially detects the sizes of the respective original document sheets so as to store said detected sizes and the number of the original document sheets in a memory means;

an original document size comparing means which detects the size of the original document sheet fed after strating of the copying function for comparison of this result and the size of the original document sheets stored in said original document memory means;

an original document number comparing means for comparing the number of the original document sheets fed by the time of termination of the copying function and the number of the original document sheets stored in said memory; and a warning display means for giving warning when the results of comparison of said original document size comparing means or said original document number comparing means are not in agreement with each other.

10. A copying apparatus according to claim 9, wherein said original document memory means includes a partition member for detecting the completion of one circulation.

* * * * *